United States Patent [19]

Ives

[11] 4,363,470

[45] Dec. 14, 1982

[54] GAS-ENTRAINED PARTICULATE FEED SYSTEM

[75] Inventor: Kenneth D. Ives, Valparaiso, Ind.

[73] Assignee: United States Steel Corporation, Pittsburgh, Pa.

[21] Appl. No.: 326,733

[22] Filed: Dec. 2, 1981

[51] Int. Cl.[3] ..... C21B 7/24

[52] U.S. Cl. ..... 266/81; 75/53; 75/60; 266/80

[58] Field of Search ..... 266/80, 81, 216; 75/53, 75/60

[56] References Cited

U.S. PATENT DOCUMENTS

| | | | |
|---|---|---|---|
| 3,955,966 | 5/1976 | Meichsner | 75/53 |
| 4,136,857 | 1/1979 | Kolb | 266/80 |
| 4,286,774 | 9/1981 | Benatar | 75/60 |

FOREIGN PATENT DOCUMENTS

| | | | |
|---|---|---|---|
| 1259775 | 8/1968 | Fed. Rep. of Germany | 266/80 |

*Primary Examiner*—P. D. Rosenberg

*Attorney, Agent, or Firm*—William F. Riesmeyer, III

[57] ABSTRACT

Apparatus is provided for preventing reaction forces on a flow control valve from affecting measurements of particulate feed rate, where such measurements are made using weighing devices to determine the amount of particulates in a supply container as a function of time. The apparatus includes means for applying sufficient compressive prestress to spacer bars for absorbing reaction forces on the valve so that extension of the staybars is prevented during particulate feeding. Movement of the container due to reaction forces on the valve is prevented and particulate feed rate errors are substantially eliminated.

5 Claims, 1 Drawing Figure

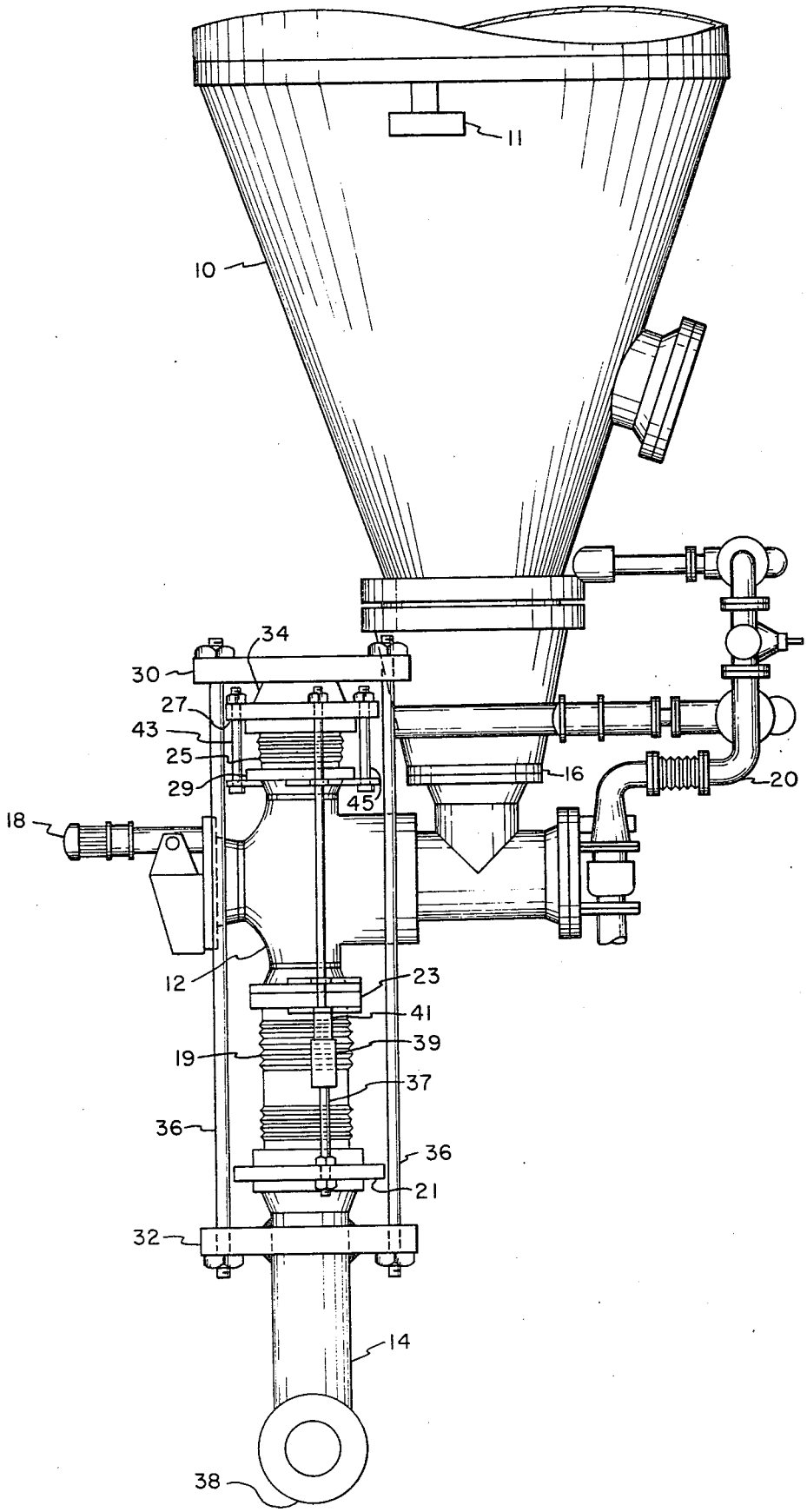
11
10
34
30
27
43
25
29
45
16
20
18
12
23
41
39
19
37
36
36
21
32
14
38

GAS-ENTRAINED PARTICULATE FEED SYSTEM

BACKGROUND OF THE INVENTION

This invention relates to pressurized gas-entrained particulate feed systems, and particularly to systems where feed rate is determined from differential measurements of a particulate supply container.

In certain steelmaking processes, flux materials such as limestone, burned lime, or fluorospar, may be introduced into the steelmaking vessel by injecting them in powdered form, entrained in a pressurized refining gas. A system for controlling injection of fluxes to be introduced in this manner is shown in U.S. Pat. No. 4,136,857 Kolb. In this system, the flux feed rate is measured by differential weight of the feed hopper, as indicated by load cells mounted between the hopper and its supports.

The feed rate measurements have been subject to some degree of error, generally attributed to load cell inaccurracy, valve movement and other unknown factors. The primary cause of error was not readily apparent, although it was recognized that the degree of error varied generally in proportion to operating gas pressure. Efforts have been made to eliminate the effect of valve movement by providing sturdier supports, but these have not been notably successful.

It is a primary object of this invention to provide an improvement in pressurized gas-entrained particulate feed systems substantially eliminating errors in flow rate measurements caused by deviations in differential weight measurements of a container for holding a supply of the particulates.

SUMMARY OF THE INVENTION

The present invention is applicable generally to any process in which particulates are introduced into a process vessel in powdered form entrained in a pressurized carrier gas. The conventional feed system includes a container for holding a supply of the particulates, a pipe system connecting the container and process vessel, and means for supplying gas to the container and pipe system for transferring the particulates from the container to the vessel. Means is provided for indicating differential weight of the container in order to measure the feed rate of particulates. Generally, load cells mounted between the container and its supports are used for this purpose. A flow control valve is also provided for regulating the flow of gas and particulates. Finally, an expansion means and spacer bar assembly are provided for (a) permitting free vertical movement of the container for weighing purposes without restraint by the pipe system, and (b) absorbing reaction forces on the valve caused by flow of pressurized gas through the valve outlet. In the improvement of this invention means is provided, in combination with the conventional apparatus above-recited, for applying sufficient compressive prestress to the spacer bar means to substantially prevent extension of the spacer bars during feeding. Thus, weight measurements of the container are not significantly affected by reaction forces on the valve since valve movement is prevented. The apparatus may desirably include a stationary support member, an abutment member, and means mounted between the two members for exerting force against the abutment member and thus apply compressive prestress to the spacer bar means.

BRIEF DESCRIPTION OF THE DRAWINGS

The sole FIGURE is a side elevation view of a flux injection system for a steelmaking converter showing the apparatus of this invention.

DESCRIPTION OF THE PREFERRED EMBODIMENT

The instant invention represents an improvement in a flux feed system more specifically described in U.S. Pat. No. 4,136,857, Kolb, the specification of which is incorporated herein by reference. Referring now to the sole drawing, a feed hopper tank 10 is provided for storage of lime or other fluxes to be supplied to a steelmaking vessel (not shown). To provide a measure of the weight of the hopper, load cells are mounted between the hopper and its supports. Generally three spaced load cells are provided defining a plane of support, one being schematically illustrated at 11 in the drawing. Flow regulation valve 12 is connected to pipeline 14 which extends to the steelmaking vessel (not shown), and is also connected to outlet 16 of the hopper. The valve typically is of the type described in German Pat. No. 1,259,775 Stamer et al. Motor drive 18 operates to vary the size of outlet 16 to control the amount of flux supplied to the vessel. Branch pipe 20 supplies a pressurized oxygen gas stream which entrains flux particles, transferring them to the vessel as desired.

In order to permit weighing, the hopper must be able to move freely in a vertical direction without restraint by pipeline 14. To accomplish this an expansion bellows 19 is connected between flanged plates 21, 23 of the pipeline and valve. A second expansion means is provided to absorb reaction forces on the valve due to flow of pressurized gas through it. This latter expansion means may be in the form of bellows 25 which is mounted between plates 27, 29 as shown in the drawing. A plurality of spacer bars, one of which is shown at 37, serve as guides for movement of the valve and hopper with respect to the fixed pipeline. The bars are secured by nuts to outer plates 21 and 27 but are slidably mounted in holes through plates 23 and 29. Threaded sleeves 39, 41 allow adjustment of the length of each spacer bar. Guidebars may also be provided to guide movement of the individual expansion means, as for example is shown by bars 43, 45 slidably mounted in plate 27 and secured by nuts to plate 29.

The improvement of this invention involves applying sufficient compressive prestress to the spacer bars to substantially prevent extension of their length due to reaction forces on the valve during feeding. Thus, movement of the hopper due to such forces is prevented, eliminating the effect on weight measurements and associated indications of feed rate. Apparatus is provided for this purpose and includes stationarily mounted support 32 which desirably may be fixed directly to pipeline 14 by welds as illustrated, or mounted beneath elbow 38, or if desired mounted independently of the pipeline itself. An abutment 30 is located adjacent expansion bellows 25. It may abut directly against plate 27, or against a compression spring 34 which may be provided if desired. Threaded connector bolts 36 draw the support and abutment together when the nuts are tightened and serve to create precompressive stress in the spacer bars.

It will be apparent that variations on the embodiments disclosed will accomplish the same result. For example, the support may be mounted above the abutment and a fluid powered cylinder or screwjack provided to exert force between the members. Similarly, means may be provided of sufficient weight to exert force downwardly on the spacer bars in order to create the desired compressive prestress. These and other embodiments of the invention will be readily apparent to those skilled in the art and are included within the spirit and scope of the appended claims.

I claim:

1. In apparatus for feeding particulates entrained in a pressurized gas to a process vessel, said apparatus including a container for holding a supply of particulates, means for indicating differential weight of said container in order to measure particulate feed rate to the vessel, a pipe system connecting said container to the process vessel, means for supplying gas to said container and pipe system, a valve having inlet and outlet ports connected in said pipe system for regulating flow of gas and particulates to the vessel, and an assembly including cooperating expansion means and spacer bar means for (a) permitting free vertical movement of said container for weighing purposes without restraint by said pipe system, and (b) absorbing reaction forces on said valve due to flow of pressurized gas through the outlet thereof, the improvement in said apparatus which comprises:

means for applying sufficient compressive prestress to said spacer bar means to substantially prevent extension thereof during feeding of particulates to said vessel, whereby, weight measurements of said container are not significantly affected by reaction forces on said valve.

2. The apparatus of claim 1 wherein said valve is aligned so that the outlet thereof extends axially in a downward vertical direction.

3. The apparatus of claim 1 wherein said means for applying compressive prestress includes a stationary support member, an abutment member located adjacent to a side of said valve directly opposite the outlet thereof, and means mounted between said members for exerting force against said abutment member so as to apply compressive prestress to said spacer bar means.

4. The apparatus of claim 3 further comprising compression spring means mounted between said abutment member and spacer bar means.

5. The apparatus of claim 3 wherein said support member is located downstream of said valve outlet, and said means for exerting force mounted between the members comprises threaded connector means.

* * * * *